US005920636A

United States Patent [19]

Oliveira et al.

[11] Patent Number: 5,920,636

[45] Date of Patent: Jul. 6, 1999

[54] DISPOSABLE FOAM SLEEVE FOR SOUND CONTROL DEVICE AND CONTAINER THEREFOR

[75] Inventors: Robert J. Oliveira, Maplewood; Martin P. Babcock, White Bear Lake; Davis W. Chamberlin, Saint Paul, all of Minn.

[73] Assignee: Hearing Components, Inc., Oakdale, Minn.

[21] Appl. No.: 09/050,203

[22] Filed: Mar. 30, 1998

[51] Int. Cl.[6] ..... H04R 25/00

[52] U.S. Cl. ..... 381/328; 381/330; 181/130

[58] Field of Search ..... 381/309, 322, 381/324, 325, 327, 328, 330, 370, 371, 380, 382, 60; 181/129, 130, 135; 2/209; 379/430

[56] References Cited

U.S. PATENT DOCUMENTS

| | | | |
|---|---|---|---|
| 2,453,238 | 11/1948 | Locke, Jr. | 206/16 |
| 3,983,336 | 9/1976 | Malek et al. | 381/328 |
| 4,420,657 | 12/1983 | Larkin | 181/129 |
| 4,466,539 | 8/1984 | Frauenhoffer | 206/370 |
| 4,724,922 | 2/1988 | Kalayjian | 181/130 |
| 4,880,076 | 11/1989 | Ahlberg et al. | 181/130 |
| 5,002,151 | 3/1991 | Oliveira et al. | 181/130 |
| 5,402,887 | 4/1995 | Shillington | 206/366 |
| 5,415,315 | 5/1995 | Ramirez | 220/346 |
| 5,682,020 | 10/1997 | Oliveira | 181/130 |

*Primary Examiner*—Huyen Le
*Attorney, Agent, or Firm*—Richard E. Brink

[57] ABSTRACT

An improved sleeve for mounting on the distal portion of a hearing aid or other sound control device to provide circumferential contact to the ear canal of a person into which the device is inserted. A currently preferred embodiment of the sleeve comprises a foam cylinder having an axial hole therethrough, with a washer-like disc axially aligned with the hole in the cylinder, the inner diameter of the disc being approximately the same as that of the hole through the cylinder. A knob-terminated sound delivery tube on the device snaps into the disc. A plurality of these sleeves can be stored in a novel tray-like container that permits removal only when a snap fit has been achieved between the sound delivery tube and the plastic disc. Used sleeves can be removed and stored in a separate compartment of the container.

14 Claims, 4 Drawing Sheets

DISPOSABLE FOAM SLEEVE FOR SOUND CONTROL DEVICE AND CONTAINER THEREFOR

BACKGROUND OF THE INVENTION

This invention relates to disposable foam sleeves for providing circumferential contact between a sound control device (a device for wholly, partially, or selectively blocking, transmitting, or amplifying sound), e.g., an ear plug, a stethoscope, a hearing aid, etc., that is inserted into a user's ear canal. The invention finds a particular use when it is applied to the distal portion of a CIC (completely in the canal) hearing aid to provide a seal to the walls of a user's ear canal. Such sleeves can eliminate the annoying feedback that otherwise often occurs when a hearing aid wearer is dining with friends or talking on the telephone. In another aspect the invention relates to a kit comprising a container holding unused sleeves and enabling the convenient disposal of used sleeves.

U.S. Pat. Nos. 4,880,076 and 5,002,151 both disclose hearing aids that, are modified in various ways to accept complementary user-disposable foam sleeves adapted to mount on and fit around the distal portion of the hearing aid to seal it to the user's ear canal. Although technically feasible, all these combinations have thus far proved commercially unappealing, both because of their technical complexity and their relatively high cost. U.S. Pat. No. 5,682,020 describes another way of sealing a hearing aid to a user's ear canal, viz., by removably adhering a foam layer to the otherwise canal-contacting periphery of the hearing aid. Although this technique is quite effective, the process of adhering the foam to the proper location requires a degree of manual dexterity sometimes lacking in persons who wear hearing aids. Yet another prior art technique involves permanently adhering a foam ring to the hearing aid, thereby preventing the user from removing and replacing it. In the absence of adhesive, such a ring is likely to slide off and remain in the ear canal when the hearing aid is removed.

BRIEF DESCRIPTION

The present invention provides a simple and inexpensive foam sleeve that is not only easy to apply to the distal portion of a sound control device to provide circumferential contact with a user's ear canal but also easy to remove, even by children or those enfeebled by age or infirmity. The sleeve comprises a cylinder of resilient foam (preferably slow recovery foam) having an axial hole extending therethrough, with a stiff disc (preferably of stiff but deformable plastic) affixed to one end, the disc having a hole that is axially aligned with the hole extending through the cylinder. A sound control device terminating in a knob-like portion adapted to mate and interlock complementarily with the hole in the disc can first be inserted through the sleeve and then through the hole in the disc, where the complementary parts provide a mechanical interlock holding the sleeve on the sound control device.

The diameter of a human ear canal is on the order of 5 mm. in diameter, and the foam sleeves, which. are accordingly quite small, would be expected to be difficult either to install on or remove from the distal portion of a sound control device. This problem is simplified by the novel package in which the sleeves are contained. A plurality of foam sleeves can advantageously be packaged in a tray-like container, where each sleeve is positioned, disc side down, over a depression in the bottom, each such depression having a diameter somewhat less than the outer diameter of the disc. Over the tray of sleeves is then mounted a plate provided with holes aligned with the depressions but having an effective diameter intermediate that of the sleeve and the disc. To remove a sleeve from the tray, the distal end of a sound control device is inserted downward through the appropriate hole in the plate and then through the sleeve. The distal end of the sound control device is then forced through the complementary hole in the disc, which is supported by the portion of the bottom circumjacent to the depression, and locked thereto as it is forced into the depression. When the sound control device is then lifted, the foam sleeve or the area surrounding the hole in the plate yields slightly to permit withdrawal of the device without detaching the disc. If, however, a satisfactory locking fit has not been attained, the foam sleeve's contact with the peripheral area of the hole in the plate causes the sleeve to slip off the sound control device and remain in the tray. It is important to have the sleeve securely mounted on the sound control device to avoid the problem of having it become detached and remain in the ear canal when the sound device is removed.

The container can be further modified by providing a wall to divide it into a first compartment for unused sleeves and a second compartment for used sleeves. The second compartment can be accessed by providing a modified keyhole slot in either the upper plate or a lower plate covering the bottom of the tray. This slot preferably includes a first hole, a second smaller hole, and a rectangular portion connecting the two. The diameter of the first hole is somewhat greater than the diameter of the sleeve, and the diameter of the second hole is slightly greater than the diameter of the disc but less than the diameter of the sleeve. The distal portion of a sound control device on which a sleeve is mounted is inserted through the larger hole of the keyhole far enough to position below the plate the entire sleeve and the upper portion of the sound control device that cooperates with the disc to hold the sleeve in place. The assembly is then slid along the rectangular part of the keyhole to the smaller hole. Applying a lifting force to the sound control device will cause the sleeve to spring loose and be deposited within the second compartment.

BRIEF DESCRIPTION OF THE DRAWINGS

Understanding of the invention will be enhanced by referring to the accompanying drawings, in which like numbers refer to like parts in the several views. For convenience, much of the description that follows is directed to the use of sleeves on a sound control device that is a hearing aid, but the invention should not be construed to be limited to this type of construction. In the drawings.

Figure 1:
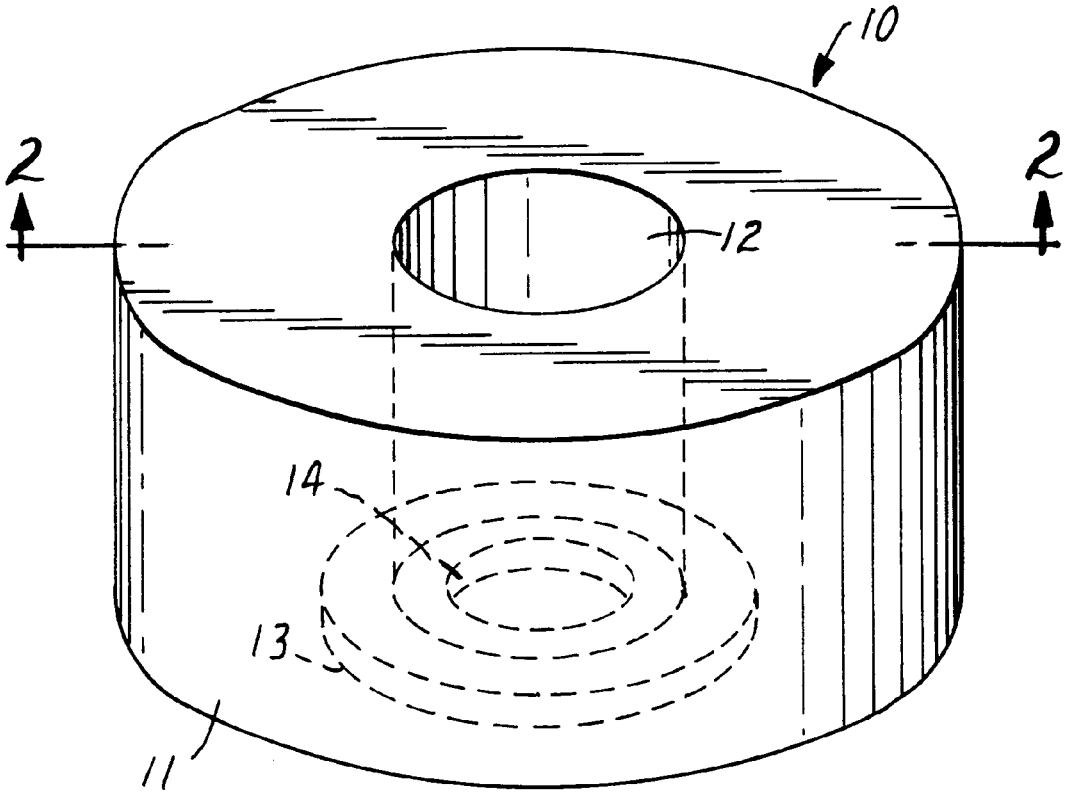
FIG. 1 is a a greatly enlarged perspective view of the sleeve of the invention.
Figure 2:
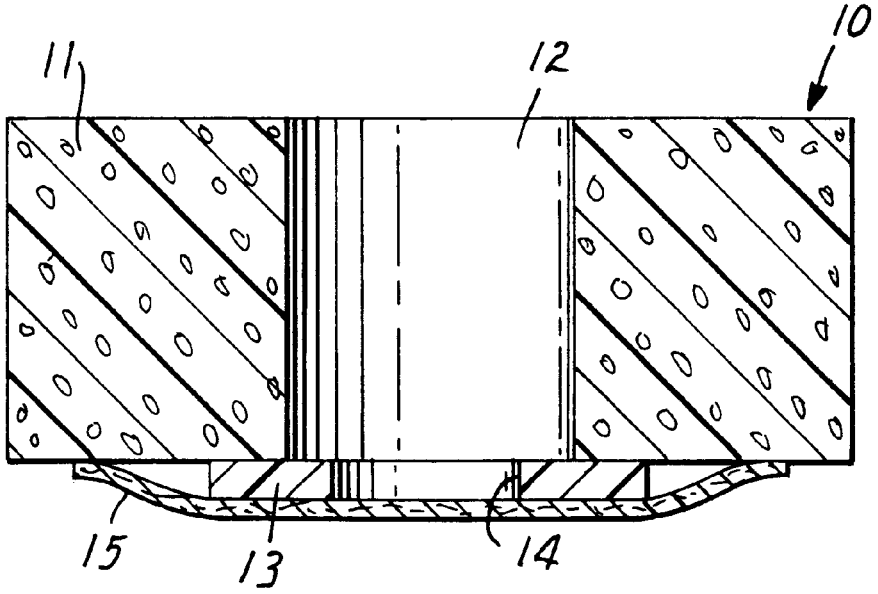
Figure 3:
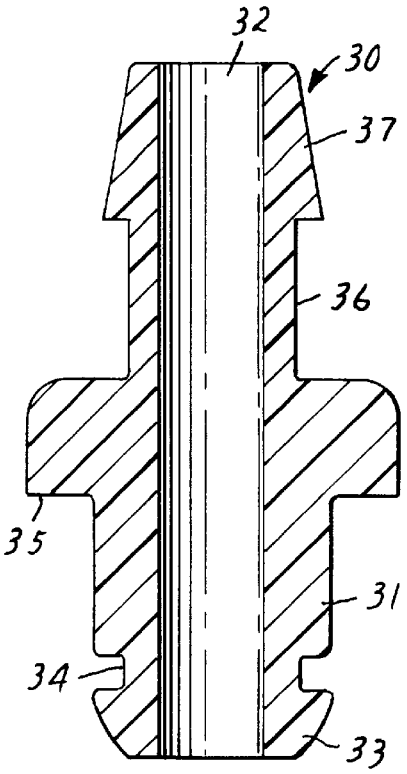
Figure 4:
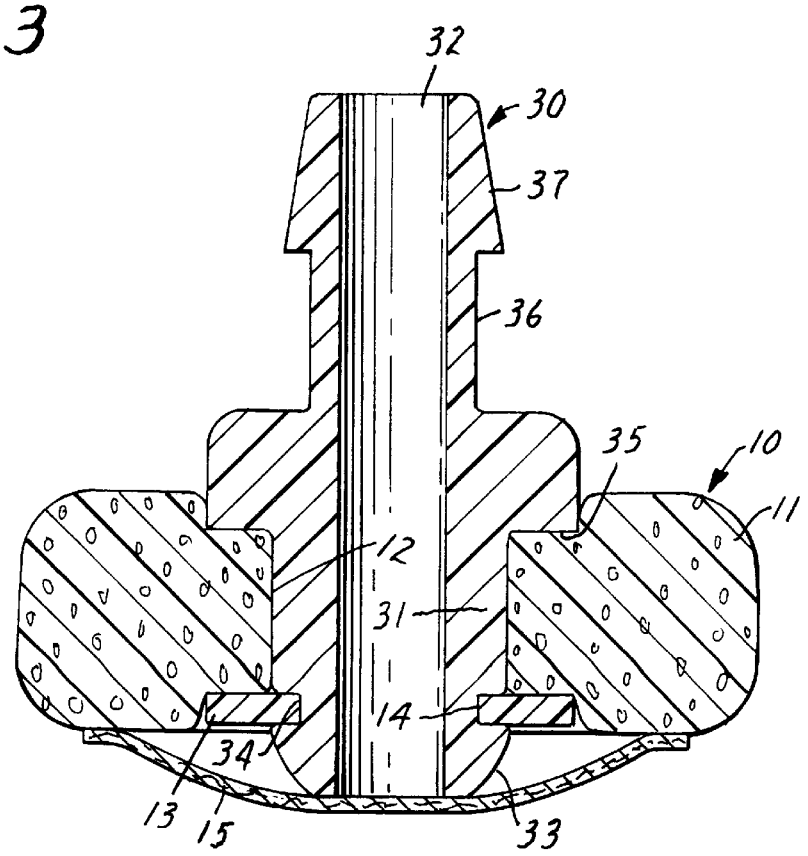
Figure 5:
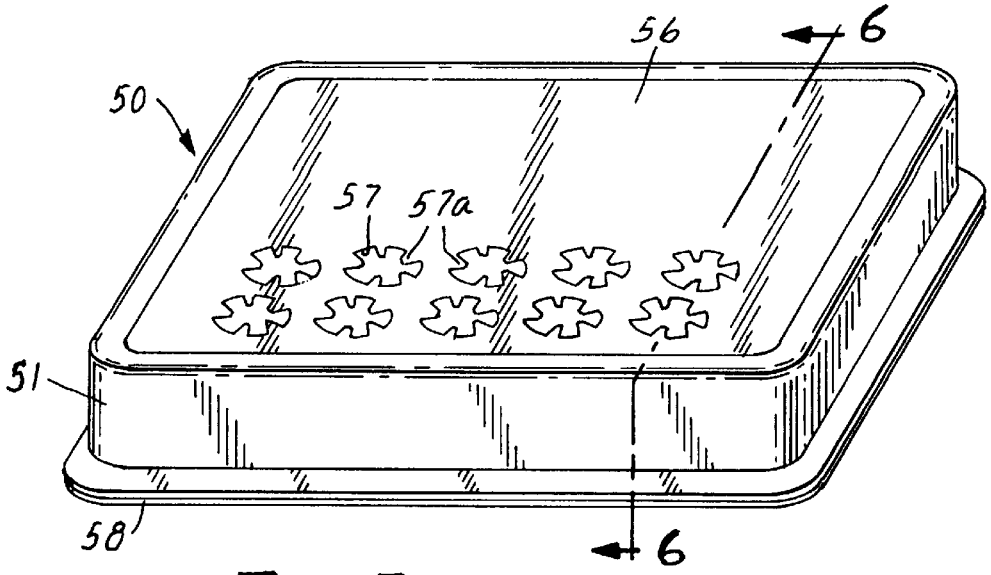
Figure 6:
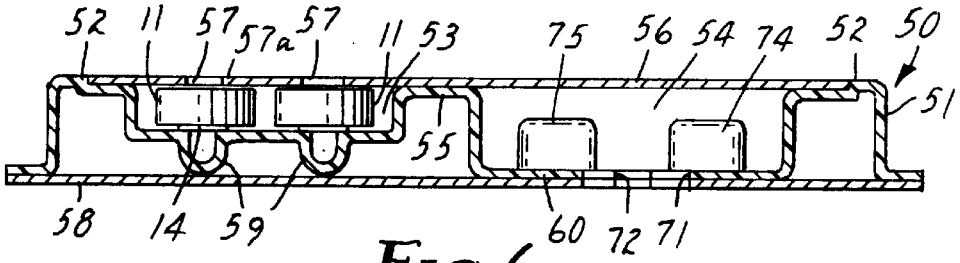
Figure 9:
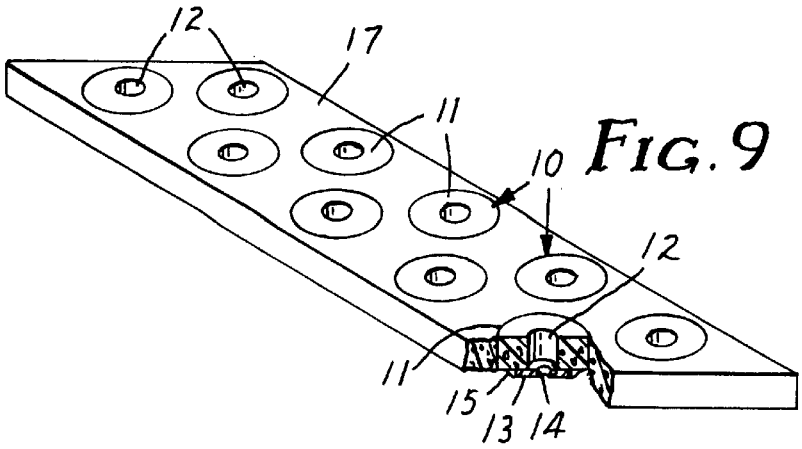
Figure 7:
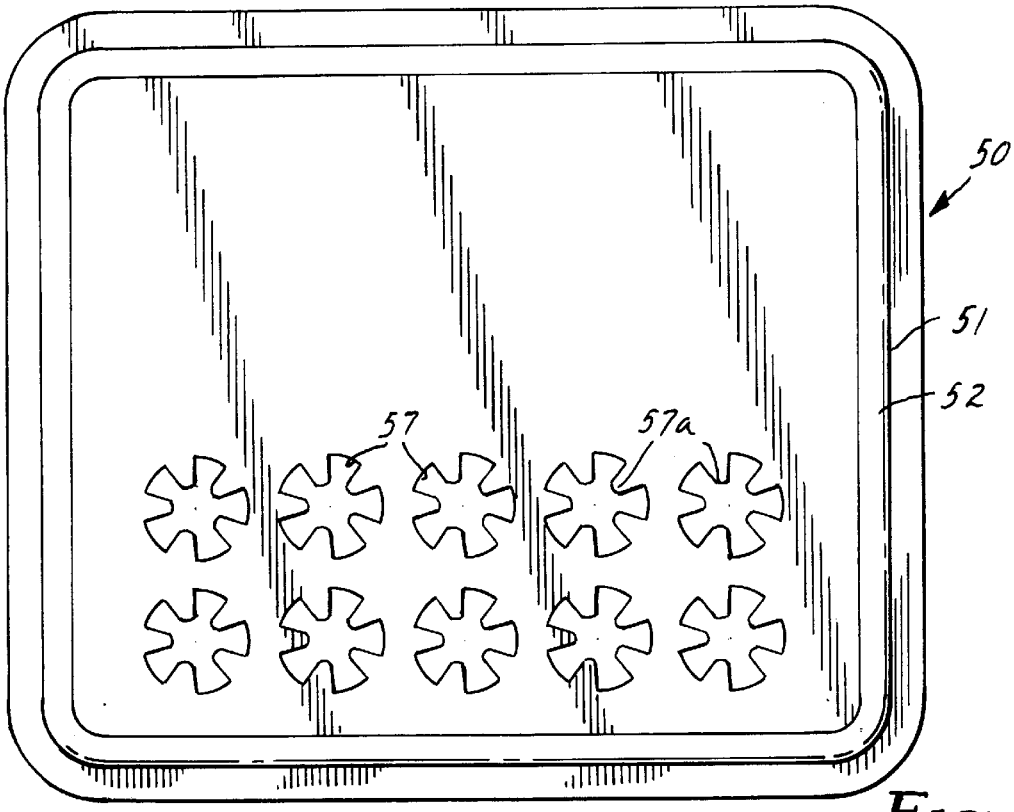
Figure 8:
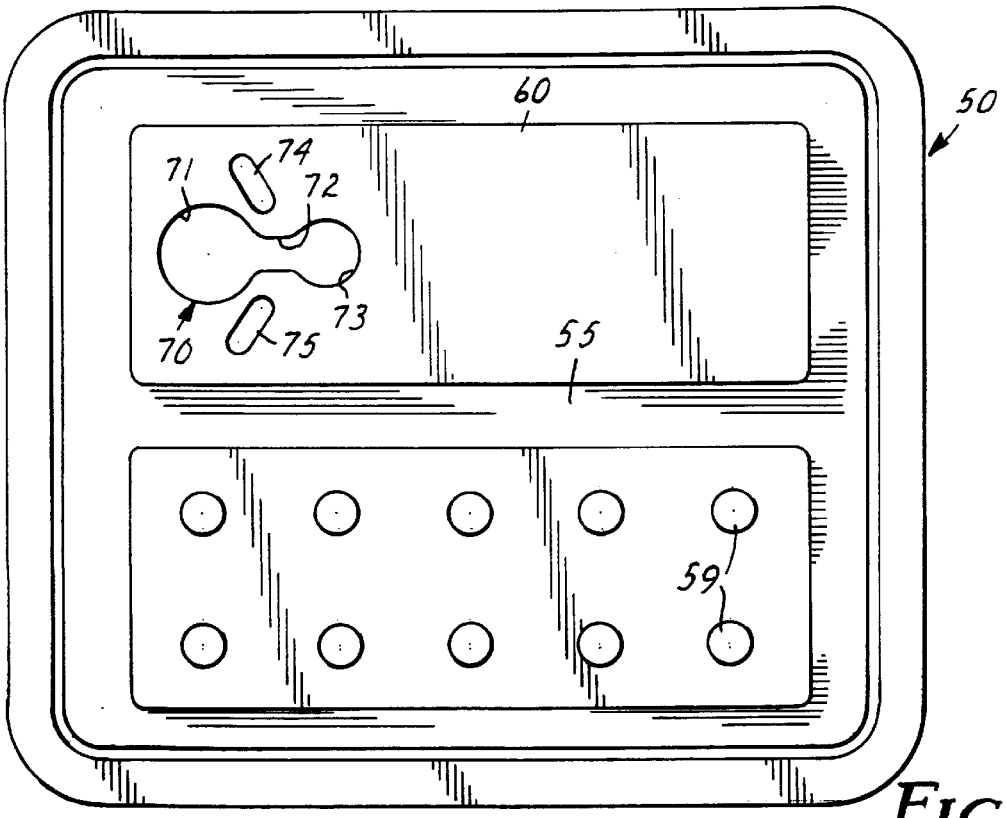

FIG, 2 is a cross-sectional view of the sleeve of FIG. 1, taken along section line 2—2 and looking in the direction of the arrows;

FIG. 3 is a greatly enlarged cross-sectional view of the distal end of a hearing aid sound-transmitting tube:

FIG. 4 is a cross-sectional view showing how the sleeve of FIGS. 1 and 2 is mounted on the sound-transmitting tube of FIG. 3;

FIG. 5 is a perspective view of a container tray for use in a kit containing a plurality of the sleeves of the invention;

FIG. 6 is a cross-sectional view of a kit comprising the tray of FIG. 5, containing sleeves of the type shown in FIG. 1, taken along section lines 6—6 and looking in the direction of the arrows;

FIG. 7 is an upper plan view of the tray of FIG. 5;

FIG. 8 is a bottom plan view of the tray of FIG. 5 with the lower plate removed to facilitate understanding of the construction; and FIG. 9 is a perspective view of a block of foam from which sleeves of the type shown in FIG. 1 have been die-cut but not physically removed from the surrounding "weed," for installing in the tray of FIG. 5, certain parts having been cut away to facilitate understanding.

DETAILED DESCRIPTION

In the drawings, sleeve 10 comprises foam cylinder 11, having axial hole 12 extending therethrough. At the lower end of cylinder 11 is affixed (e.g., by adhesive or mechanical fastening means) stiff but deformable disc 13, having hole 14 extending therethrough to form a washer-like member. Hole 14 is axially aligned with hole 12 and is about the same size, or at any rate no more than slightly larger. Preferably overlying disc 13 is a layer of sound-transmitting scrim 15 to help prevent detritus from the ear canal from entering the sound delivery tube of a hearing aid on which sleeve 10 may be mounted (FIG. 4).

FIG. 3 shows the distal end of a hearing aid sound delivery tube 30, on which the sleeve of FIGS. 1 and 2 can be mounted, as in FIG. 4. Tube 30 includes central body 31, through which sound-transmitting channel 32 extends, head (or knob) 33, and groove 34. In use, body 31 is inserted through axial hole 12 in foam cylinder 11, knob 33 then contacting the area surrounding hole 14 in disc 13. As axial force is applied, the portion of disc 13 circumjacent hole 14 yields slightly, allowing knob 33 to pass through hole 14. The circumjacent portion then springs back, seating itself in groove 34 to provide a snap fit. Sound delivery tube 30 is preferably provided with shoulder 35, further insuring that sleeve 10 will be maintained in a fixed location and slightly compressed after mounting between disc 13 and shoulder 35. As is particularly shown in FIG. 4, this compression causes cylinder 11 to bulge, thereby helping to prevent disc 13 from contacting the walls of a user's ear canal. The device shown in FIG. 3 also includes neck 36, terminating in fitting 37, enabling it to be inserted into the end of a vinyl tube associated with a hearing aid or other sound control device. In many instances the distal portion of a sound control device will be so constructed as to incorporate the features of the device shown in FIG. 3.

Turning now to FIGS. 5 and 6, tray-like container 50, preferably a vacuum-formed sheet of vinyl, comprises base 51, divided into compartments 53 and 54 by internal wall 55. Resting on peripheral ledge 52 is upper plate 56, containing a plurality of holes 57 including radially inward extending fingers 57*a* that reduce the effective diameter of holes 57 to slightly less than the diameter of foam cylinder 11. Compartment 53 includes a floor, from the lower surface of which protrude depressions 59 that are directly below holes 57, the diameter of depressions 59 being somewhat less than the outer diameter of discs 13 but somewhat greater than the diameter of head 33. To withdraw a sleeve 10 from compartment 53, the user inserts a knob-headed sound delivery tube 30 through hole 57 in upper plate 56 and then through axial hole 12 in sleeve 10. While disc 13 is supported by the part of the floor circumjacent depression 59, head 33 is snapped through hole 14, head 33 extending into depression 59. The area circumjacent to hole 14 in disc 13 thus becomes seated in groove 34. Removal of sound delivery tube 30 through hole 57 in plate 56 also removes sleeve 10, which, as has been shown, is now mounted on sound control device 30. Effective mounting occurs when the retaining force caused by the positioning of disc 13 in groove 34 is greater than the restraining force caused by the diameter of sleeve 10's exceeding the effective diameter of hole 57 as modified by fingers 57*a*. If for some reason, a snap fit of disc 13 in groove 34 has not been achieved, removal of sound delivery tube 30 will not be effective to remove sleeve 10, which will fall off when encountering the portions of plate 56 circumjacent hole 57. Such failure occurs because the diameter of sleeve 10 exceeds the effective diameter of hole 57 and is restrained by the failure of fingers 57*a* to yield enough to allow it to pass through hole 57.

Attention is now directed to FIGS. 6–8, where, in a portion of cardboard cover 58 and bottom 60 covering compartment 54, keyhole slot 70 is cut out to provide a means for removing used sleeves from sound delivery tubes and automatically storing them in compartment 54. Keyhole slot 70 comprises major hole 71, rectangular slot 72, and minor hole 73. The diameter of hole 71 is approximately the same as, or slightly greater than, the diameter of sleeve 10, while the width of rectangular portion 72 is slightly greater than the diameter of neck 36. The diameter of hole 73 is noticeably less than the diameter of sleeve 10 and slightly greater than the diameter of shoulder 35. To remove a sleeve from a sound delivery tube on which it is mounted, the assembly is inserted through larger circular hole 71 and slid along rectangular portion 72 to smaller circular hole 73. Projections 74 and 75 are so angled as to permit the assembly to be slid toward hole 73 but to resist movement back toward hole 71. The sound delivery tube is then pulled away from plate 60, the resultant force causing the portion of disc 13 circumjacent hole 14 to spring away and allow sleeve 10 to be deposited in compartment 54.

FIG. 9 illustrates a convenient way of incorporating a plurality of sleeves 10 in the tray of FIG. 5 and holding them in the proper position between holes 57 and depressions 59. Foam slab 17, corresponding in shape to compartment 53 and having a series of discs 13 affixed to its lower surface, is die-cut to delineate individual sleeves 10 without physically removing them from the surrounding "weed."

It will be readily appreciated that those skilled in the art, having read the foregoing disclosure, will be able to make numerous modifications and applications without departing from the spirit of the invention. To illustrate, sleeve 10 may be formed from foam having other than a classically cylindrical shape; e.g., cylinder 11 may have the shape of a truncated cone. It may be desirable for foam cylinder 11 to have an oval cross-section, more closely approximating the oval cross-section of the human ear canal; in such event, disc 13, hole 14, head 33 and groove 34 may likewise be oval to help provide self-orientation of the sound control device. For specific uses, it may be desirable for foam cylinder 11 to have the shape of a truncated cone. Similarly, the circumference of the cylinder may be fluted, providing channels for low frequency sounds to escape from the ear canal. Other modifications may be appropriate for hearing aids designed to amplify or depress certain frequencies, as in hearing aids for reducing the sound of muzzle blasts in trap shooting while amplifying sounds that can improve safety and accuracy; other specialized hearing aids may amplify the high frequencies of sounds made by birds and wildlife.

To make the hole in the disc more easily penetrated by the knob at the distal end of a sound control device, it may be provided with radially extending slits. A variety of other complementary locking systems could also be used to attach sleeve 10 to a sound control device; for example, the knob on the distal end of the sound control device might have a rectangular cross-section, with hole 14 in disc 13 being correspondingly rectangular, so that, after inserting the distal end of the device through hole 14, a quarter turn would provide an effective interlocking means. Other interlocking arrangements can readily be envisioned. It will, of course, be recognized that where greater lengths of foam cylinder 11 are desired, a stack of sleeves may be mounted on the sound control device, in which event only the most distal cylinder will be provided with a locking means.

If desired, container 50 may be provided with a lid, shrink wrapped, or slid into a cardboard sleeve. As previously pointed out, foam sleeves 10 may either be held in appropriately sized recesses in compartment 53 or die-cut from a block of foam but not separated from the surrounding "weed," the entire block thus being placed in compartment 53. To further illustrate other modifications, telemarketers, who use and insert sound delivery tubes into their ear canals, may employ sound delivery tubes having a snap-on open cell resilient foam sleeve of the type described, thus providing sound that is directed into their ear canals without isolating them from their environment. Similarly, ear plug cores smaller than the ear canal diameter could be preshaped to take account of the ear canal's tortuosity and provided with snap-on foam sleeves of appropriate diameter to provide a family of reusable ear plugs.

In view of all such and other obvious variations of the invention, the following claims should be construed with full appreciation for and recognition of the doctrine of equivalents.

What is claimed is as follows:

1. A sleeve for removably mounting on the distal end of a sound control device terminating in a knob portion to provide circumferential contact with the ear canal of a user into which the device is inserted, comprising in combination a cylinder of resilient foam, an axial hole extending through said cylinder, and an attachment disc affixed to one end of said cylinder, said disc having a hole axially aligned with the axial hole through said cylinder, whereby said knob portion can be inserted through the axial hole in the cylinder and then through the hole in the disc, the knob portion and the area circumjacent to the hole in the disc cooperating to provide a complementary interlock holding said sleeve on said sound control device.

2. The sleeve of claim 1 wherein the resilient foam is a slow recovery foam.

3. The sleeve of claim 2 wherein the sound control device is a hearing aid distally terminating in a sound delivery tube.

4. The sleeve of claim 3 wherein the disc is protectively-covered with a scrim material to help block the entrance of debris from a user's ear canal into the sound delivery tube.

5. The sleeve of claim 4 mounted on the knob-ended distal portion of the sound control device.

6. A package containing a plurality of the foam sleeves of claim 1, said package comprising a tray container having an upper plate with a plurality of holes extending therethrough, said holes having a slightly smaller effective diameter than the diameter of the foam sleeves, the bottom of said container having a plurality of depressions, each such depression aligned with a corresponding hole in the the upper plate, the diameter of each such depression being less than the outer diameter of the plastic disc of the foam sleeve, said sleeves being located between the upper plate and the bottom of said container, each such sleeve having a diameter slightly greater than the effective diameter of the corresponding hole in the upper plate, whereby the sleeves resist removal from the container unless attached to the knobbed distal end of the sound control device but are readily removed when so attached.

7. The package of claim 6, further characterized by having a cardboard cover below the bottom of the container and a wall dividing the container into two compartments, a first compartment containing unused sleeves and a second compartment adapted to receiving and storing used sleeves.

8. The package of claim 7, wherein a portion of either the upper plate or the bottom adjacent the compartment for storing used sleeves is provided with a keyhole slot having a first circular hole, a rectangular portion, and a second circular hole, the first hole having a diameter slightly greater than that of the sleeves, the rectangular portion having a width less than the outer diameter of the portion of the sound control device against which the foam cylinder is abutted and the diameter of the second circular hole being noticeably less than the diameter of said sleeves and slightly greater than the outer diameter of the portion of the sound control device against which the foam cylinder is abutted, whereby the sound control device on which the used sleeve is mounted can be inserted through the first hole of the keyhole slot, moved along the rectangular portion to the second hole, and lifted, thereby detaching the used sleeve and depositing it in the second compartment.

9. The package of claim 8 wherein projections adjacent the keyhole slot are so angled as to permit a sleeve mounted on a sound delivery tube to be readily slid toward the second hole but to resist movement back toward the first hole.

10. A method of removing a sleeve from the package of claim 9, comprising the steps of inserting the knobbed distal end of the sound control device through one of the holes in the upper plate and thence through the sleeve beneath said hole, said sound control device having a groove around its circumference, forcing the disc on said sleeve against the portion of the bottom of the package circumjacent to the underlying depression, thrusting the knob through the hole in said disc and into said depression to lock said disc in said groove, and lifting the thus-mounted sleeve from the package.

11. The package of claim 6 wherein the knobbed distal end of the sound control device extends, sequentially, through one of the holes in the upper plate, through the foam cylinder of the sleeve positioned below said hole, and finally through the hole in the disc, locking the sleeve on the sound control device so that it can be removed from the package.

12. A plurality of the sleeves of claim 1 individually delineated within a block of foam in which they are incorporated without being physically removed therefrom.

13. A sleeve for removably mounting on the distal portion of a knob-ended sound control device of the type inserted into a human ear canal, comprising in combination a cylinder of resilient foam, the diameter of said cylinder being such as to provide circumferential contact with the ear canal when inserted thereinto, an axial hole extending through said cylinder, a stiff but deformable attachment disc affixed to one end of said cylinder and having a hole axially aligned with the axial hole through said cylinder, whereby the sound control device terminating in a knob portion that is slightly larger than the hole in said disc can be inserted through the axial hole in the cylinder and the knob portion then forced through the hole in the disc, the area circumjacent to the hole in said disc yielding temporarily to provide a snap fit and lock the sleeve on the sound control device.

14. The sleeve of claim 13 mounted on the distal end of the sound control device.

* * * * *